United States Patent [19]

Paulus et al.

[11] 4,044,177

[45] Aug. 23, 1977

[54] METHOD OF DECORATING AN EMBOSSED PLASTIC STRIP

[75] Inventors: Peter V. Paulus, Ypsilanti, Mich.; Theodore Loew, Schenectady, N.Y.

[73] Assignee: The Standard Products Company, Cleveland, Ohio

[21] Appl. No.: 670,182

[22] Filed: Mar. 25, 1976

[51] Int. Cl.[2] ..... B05D 3/00; B05D 5/00; B05D 3/12

[52] U.S. Cl. ..... 427/264; 427/265; 427/270; 427/275; 427/276; 427/277; 427/289; 427/407 E; 427/407 F

[58] Field of Search ..... 427/277, 278, 261, 262, 427/264, 265, 267, 270, 272, 274, 275, 290, 259, 289, 407 E, 407 F

[56] References Cited

U.S. PATENT DOCUMENTS

| | | | |
|---|---|---|---|
| 1,845,016 | 2/1932 | D'Atri | 427/289 X |
| 1,904,417 | 4/1933 | Crystler | 427/289 |
| 2,579,044 | 12/1951 | Kober | 427/270 |
| 2,785,081 | 3/1957 | Babiarz | 427/265 X |
| 2,819,181 | 1/1958 | Thomas | 427/270 X |
| 2,992,937 | 7/1961 | Davis | 427/275 X |
| 3,110,608 | 11/1963 | Brunson et al. | 427/278 |
| 3,338,731 | 8/1967 | Sommer | 427/270 |

*Primary Examiner*—Michael R. Lusignan
*Attorney, Agent, or Firm*—Harness, Dickey & Pierce

[57] ABSTRACT

The instant invention relates to a method of decorating an extruded plastic strip which is used for ornamental purposes. In the method of the invention, a plastic strip is passed through a pair of rollers which emboss the face thereof to be decorated with a raised design. The entire decorative face is then covered with a release agent from the top surface of the raised design. A coloring material is then applied to the entire decorative surface. Excess coloring and the release agent are thereafter washed, peeled, or otherwise removed from the strip. The design is then highlighted by the coloring material thereupon.

3 Claims, 4 Drawing Figures

METHOD OF DECORATING AN EMBOSSED PLASTIC STRIP

BACKGROUND OF THE INVENTION

It is a common practice to highlight selected areas of an embossed pattern on a plastic strip with a contrasting or complementary color. Prior application techniques include foil stamping, roll coating or manual painting. However, transfer from a coated foil to a substrate is a relatively expensive procedure and the durability of the color often proves unsuitable in some applications. Where the embossed pattern is of intricate design, the paint or die used in a painting technique often overruns the specific areas to be highlighted. The present invention contemplates an improved method of imparting a controlled decorative highlight to an embossed plastic strip on a mass production scale.

SUMMARY OF THE INVENTION

The present invention relates to a method of strictly controlling the coloring process of an intricate pattern, such as a filigree, on a plastic strip. The plastic strip is preferably extruded from a resin of the thermoplastic type which is readily reformed because of its thermoplastic nature. The strip is advanced through a set of embossing rollers which produce a raised design on the decorative face thereof. In a constructed embodiment, the design comprises parallel spaced ridges near the edges of the strip with a filigree therebetween. A release agent which may be a wax solution, polyethylene emulsion, polyvinyl alcohol, water glass, sodium silicate or other suitable agent, is then sprayed over the decorative face. The strip is then accurately guided by a continuous chain beneath a plurality of fine grinding wheels which grind off the upper or outermost face of the raised portion of the decorative face to remove the release agent from the top areas thereof. The strip is then advanced through an air blast which cleans off the ground particles and is further advanced to a coloring station which coats the entire decorative face of the strip with a gold, silver, or any desired contrasting or complementary color. The strip is then advanced under a hot air blast which cures the coloring material and thoroughly bonds it to the ground areas of the design. The strip is then advanced through a detergent wash, through a rinse, and then through a drying area, leaving the raised design on the decorative faces of the strip highlighted with color.

DESCRIPTION OF THE PREFERRED EMBODIMENT

The method of the present invention has a broad field of application to extrudable thermoplastics such as polyethylene, polypropylene, polyvinyl chloride, polystyrene, polyvinyl acetate and acrylonitrile tributylstyrene. Although the thermosetting compounds may be treated in the manner disclosed herein, the physical characteristics of these materials restrict their general usage and require a somewhat different initial forming method in that conventional embossing is rendered difficult if not impossible. To accomplish the objects of the present invention, it has been found most satisfactory to extrude a suitable base strip of vinyl or butyrate compound.

Figure 1:
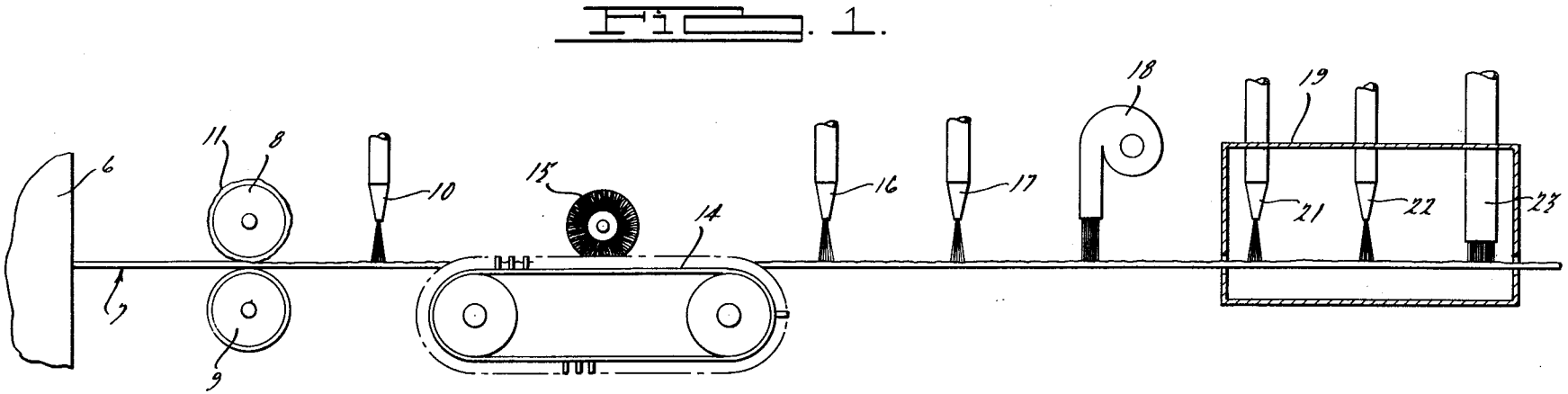
FIG. 1 is a diagramatic view of a production line which practices the present method of producing a decorative strip.
Figure 4:
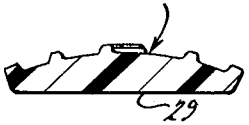
FIG. 4 is a sectional view of another type of strip.
Figure 3:
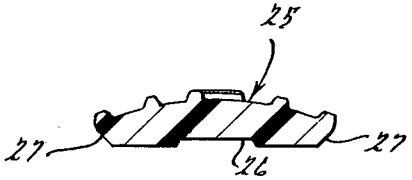
FIG. 3 is a sectional view of one type of strip.

As illustrated in FIG. 1, an extruder 6 produces a base strip 7 which is, for example, 0.750 inches wide and 0.125 inches thick so as to be usable as an ornamental trim strip on automobiles, trucks, motor boats, in the home, and on various types of cabinets. It is to be understood that the specific dimensions are recited by way of example, as various shapes and sizes of trim strips may be produced by the method of the instant invention.

Figure 2:
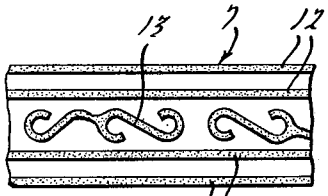
FIG. 2 is a face view of the extruded ornamental strip produced by the method illustrated in FIG. 1.

The strip 7 is advanced through a pair of rollers 8 and 9, the roller 8 having an embossing surface 11 which, as illustrated in FIG. 2, produces a decorative face comprising parallel ridges 12 adjacent to the edges and a filigree 13 in the central portion thereof between the ridges 12. The filigree 13 may be higher than the ridges 12 which also may be offset from each other.

The strip 7 is advanced from the rollers 8 and 9 to a spray nozzle 10 which applies a release agent over the entire decorative face of the strip 7. The release agent may be a wax solution, polyethylene emulsion, polyvinyl alcohol, water glass, sodium silicate or other suitable agent. The selection of a release agent is determined by the type of a plastic material from which the strip 7 is extruded, which, in a preferred embodiment, is a polyethylene emulsion used with a vinyl strip.

The strip 7 is then advanced on an endless belt 14 beneath a plurality of fine grinding wheels 15 situated at such a height relative to the strip 7 as to grind off the upper surfaces of the ridges 12 and the filigree 13. The position of the grinding wheels 15 is such as to remove the coating of release agent without significantly reducing the height of the raised portions 12 and 13.

The strip 7 then passes under an air jet 16 to remove any grinding residue. Obviously, a vacuum process can be substituted for an air blast.

The strip 7 is then advanced to a nozzle 17 which applies a selected color of paint. The paint may be applied to the entire decorative surface of the strip 7, thereby covering the release agent and also the areas from which the release agent was removed. Alternatively, the coloring material may be applied to the strip by a dip process as the strip advances. A pigmented vinyl solution has been found to be a satisfactory coloring material where the strip is a polyvinyl chloride resin. This solution bonds to the surfaces exposed by the grinding or brushing operation. Specific coloring may be achieved by acrylic resin based paints, acrylic emulsion based paints, urethane based paints, or epoxy based paints.

The painted strip 7 is then advanced beneath a hot air curing blower 18 which dries the coloring material and binds it to the ground or brushed surfaces of the strip 7. The strip 7 is then advanced to a station 19 where a detergent wash is provided by a nozzle 21, followed by a rinse from a nozzle 22, and by a drying air blast 23 which completes the operation.

Alternate methods of grinding may be employed when more than the uppermost surface of the embossed pattern is to be highlighted to remove the release agent from the leading and trailing edges of the raised pattern. For example, a brush made from very fine wire or other abrasive material may be utilized in conjunction with or in lieu of the grinding wheels. The brush will strike the raised portion of the strip slightly below the peak and will follow the contour of the peak to trail off on the downward side. This method has been found most satisfactory when a filigree pattern is embossed on the strip.

I claim:

1. The method of forming a decorative trim strip comprising the steps of: extruding a plastic strip with a decorative surface having raised portions therein, applying a release agent to the entire decorative surface of the strip, abrading the raised surfaces of said strip to remove the release agent thereon so as to expose said raised surfaces, applying a coloring material to the entire decorative surface of said strip, and removing said release agent whereby said raised portions are highlighted by said coloring material.

2. The method of claim 1 wherein said forming step comprises extruding a plastic material as a base strip and embossing a surface of said strip to form said raised portions.

3. The method of forming a decorative strip as recited in claim 1, wherein the release agent on said raised portions of the decorative surface of the strip is removed by abrading.

* * * * *